US005130168A

United States Patent [19]

Mathe et al.

[11] Patent Number: 5,130,168

[45] Date of Patent: Jul. 14, 1992

[54] ELECTROLESS GOLD PLATING BATH AND METHOD OF USING SAME

[75] Inventors: Zoltan F. Mathe, Easton; Augustus Fletcher, deceased, late of Bristol, both of Conn., by Violet Fletcher, executrix

[73] Assignee: Technic, Inc., Providence, R.I.

[21] Appl. No.: 351,924

[22] Filed: May 15, 1989

Related U.S. Application Data

[63] Continuation-in-part of Ser. No. 276,405, Nov. 22, 1988, abandoned.

[51] Int. Cl.[5] ..... C23C 26/00

[52] U.S. Cl. ..... 427/443.1; 427/304; 427/305; 427/306; 427/437; 106/1.23; 106/1.26

[58] Field of Search ..... 427/304, 305, 306, 437, 427/443.1; 106/1.23, 1.26

[56] References Cited

U.S. PATENT DOCUMENTS

| | | | |
|---|---|---|---|
| 3,589,916 | 6/1971 | McCormack | 427/304 |
| 3,700,469 | 10/1972 | Okinaka | 427/443.1 |
| 3,917,885 | 11/1975 | Baker | 427/305 |
| 3,993,491 | 11/1976 | Feldstein | 427/304 |
| 3,993,808 | 11/1976 | Inaba | 427/437 |
| 4,005,229 | 1/1977 | Miller | 427/304 |
| 4,091,128 | 5/1978 | Franz | 427/304 |
| 4,091,172 | 5/1978 | Miller | 427/304 |
| 4,118,234 | 10/1978 | Jans | 106/1.26 |
| 4,349,585 | 9/1982 | Nagashima | 427/305 |
| 4,652,345 | 3/1987 | McBride | 204/20 |
| 4,830,668 | 5/1989 | Wundt | 427/304 |

FOREIGN PATENT DOCUMENTS

| | | | |
|---|---|---|---|
| 2121444 | 12/1983 | United Kingdom | 427/304 |

*Primary Examiner*—Shrive Beck
*Assistant Examiner*—Vi Duong Dung

[57] ABSTRACT

An electroless gold plating composition comprises an aqueous solution of alkali metal gold cyanide, alkali metal cyanide, alkali metal hydroxide, a reducer selected from borohydrides and alkyl amine boranes, and a stabilizer having the formula

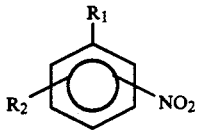

wherein $R_1$ is —COOH, —OH, —$CH_2OH$, or —$SO_3H$ (or an alkali metal salt thereof), $R_2$ l is —COOH, —OH, —Cl, —H, (or an alkali metal salt thereof) and is disposed in the 2, 5, or 6 ring position, and —$NO_2$ is in the 3 or 4 ring position. This composition has a pH of 12.5-14.0, is heated at 85°-95° C., and operates at an oxidation/reduction potential -550 to -700 millivolts to produce high purity gold deposits of amorphous structure and good hardness for electronic applications. The composition may be replenished as many as ten turnovers.

16 Claims, No Drawings

ELECTROLESS GOLD PLATING BATH AND METHOD OF USING SAME

CROSS-REFERENCE TO RELATED APPLICATION

The present invention is a continuation-in-part of Application Ser. No. 07/276,405 filed Nov. 22, 1988, abandoned.

FIELD OF THE INVENTION

The present invention is directed to electroless gold plating baths, and more particularly to providing reasonably stable electroless gold plating baths and methods for using and replenishing the same.

BACKGROUND OF THE INVENTION

Autocatalytic or electroless gold plating baths are widely employed for the development of gold deposits on both conductive and non-conductive substrates, particularly for electronics applications where optimum electrical properties in the deposit are desirable. To achieve the optimum electrical properties, it is desirable that the gold be of high purity, i.e., 99.9% or better, and that the deposit be substantially uniform over the surface of the workpiece.

Generally such electroless gold plating solutions have utilized alkali metal gold cyanide and free cyanide, and a water soluble borohydrate or an amine borane as the reducing agent. As the bath is replenished, the cyanide concentration increases, and this has an unfavorable effect upon the deposition rate and the stability of the composition. In an article by Martin Ulrich Kittel and Christoph Julius Raub entitled "Elektrochemische Stabilitaetsbestimmung Reduktiv Arbeitender Goldelektrolyte" published in Metalloberflaeche, Volume 41 (1987) at pages 309–313, there is discussed the effect of various compounds as stabilizers in gold plating compositions. None of the compounds reported by the authors serves effectively to provide a stable electroless gold plating bath which could be replenished a number of times without adverse effect upon its performance.

Accordingly, it is an object of the present invention to provide a novel and highly effective electroless gold plating composition which provides a useful rate of autocatalytic deposition of the gold upon the substrate, and which can be replenished a number of times without significantly adverse effect upon the plating rate or properties.

It is also an object to provide such an electroless gold plating composition which may be formulated readily and which is relatively stable in an industrial plating environment.

Another object is to provide a method for autocatalytic deposition of substantially pure gold upon a workpiece utilizing a relatively stable composition which can be replenished easily a number of times without significantly adverse effect upon the plating rate.

SUMMARY OF THE INVENTION

It has now been found that the foregoing and related objects and advantages may be readily attained in an electroless gold plating composition comprising an aqueous solution of alkali metal gold cyanide sufficient to provide gold (calculated as metal) in the amount of 1.0–16.6 grams per liter, and alkali metal cyanide in the amount of 3–110 grams per liter. These are also included in a boron compound selected from the group consisting of alkyl amine boranes, alkali metal borohydrides, and mixtures thereof, in the amount of 2–10 grams per liter, and alkali metal hydroxide in the amount of 10–1100 grams per liter. Lastly, there is provided 0.1–0.3 grams per liter of a stabilizer having the formula

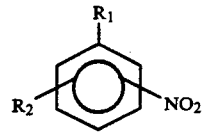

wherein $R_1$ is —COOH, —OH, —$CH_2OH$, or —$SO_3OH$ (or an alkali metal salt thereof)

$R_2$ is —COOH, —OH, —Cl, —H, (or an alkali metal salt thereof) and is disposed in the 2, 5, or 6 ring position —$NO_2$ is in the 3 or 4 ring position.

The composition has a pH of 12.5–14.0, the weight ratio of $OH^-/CN^-$ is 4.0–10.0, and the oxidation/reduction potential of the solution is −550 to −700 millivolts.

Preferably, the boron compound is dimethyl amine borane in the amount of 4–7 grams per liter, and the stabilizer is m-nitrobenzene sulfonic acid or an alkali metal salt thereof.

Desirably, the composition has, at initial makeup, alkali metal cyanide in the amount of 4.0–6.0 grams per liter, and alkali metal hydroxide in the amount of 40–50 grams per liter. The gold is present in the amount of 4–5 grams per liter as calculated as gold metal. Desirably, the solution has a pH of about 13.4–14.0. The stabilizer is desirably added in small increments during the use of the plating solution with the preferred condensation being 0.15–0.25 gram per liter.

In the method for use thereof, there is immersion plated upon the surface of a workpiece a thin deposit of immersion gold. The plated workpiece is then immersed in the aforementioned electroless gold plating composition for a period of time sufficient to plate thereon high purity gold in the desired thickness. Most desirably, the solution is maintained at a temperature of about 85°–95° C.

The composition may be replenished when the gold content (as metal) has decreased to 1.5–3 grams per liter, with a replenisher formulation comprising:

(a) alkali metal gold cyanide in the amount of 70–90 grams per liter (as metal);

(b) alkali metal hydroxide in the amount of 1–10 grams per liter; and (c) stabilizer in the amount of 2–6 grams per liter.

Desirably, the gold plating composition is prepared by first preparing an aqueous solution of the alkali metal hydroxide, alkali metal cyanide, alkali metal gold cyanide, stabilizer, and boron compound. This is heated to the operating temperature while monitoring the oxidation/reduction potential until a value of −550 to −700 millivolts is obtained after which the workpiece may be placed therein.

During the plating operation, the oxidation/reduction potential is monitored and stabilizer is desirably added in small increments of 0.05–0.1 gram per liter of the plating solution to maintain the potential of the solution within the range of −550 to −700 millivolts.

DETAILED DESCRIPTION OF THE PREFERRED EMBODIMENTS

As previously indicated, the bath of the present invention essentially requires an alkali metal gold cyanide, alkali metal cyanide, alkali metal hydroxide sufficient to maintain the desired pH and to stabilize the cyanide ion, a boron compound reducing agent, and a nitroaromatic compound as a stabilizer. These components must be maintained within certain ranges and/or ratios in order to maintain a stable composition and reasonably uniform plating rate.

Turning first to the gold component, potassium gold cyanide is preferred although sodium salt may also be employed. Lithium compounds generally involve unnecessary costs. The amount of the gold cyanide may vary within the range of 1-16.6 grams per liter (calculated as metal), but the plating rate will be significantly effected when the gold content falls below 2.0 grams per liter. Ideally, the gold content (as metal) is maintained within the range of 4-6 grams per liter.

The second component of the composition is a alkali metal cyanide sufficient to provide free cyanide in the bath. The amount of the cyanide compound may vary from as little 3 grams per liter to as much as 110 grams per liter as the bath is replenished from time to time. At makeup for the initial bath, the cyanide salt concentration is preferably in the range of about 4-10 grams per liter. The preferred cyanide salts are potassium cyanide, although sodium cyanide and lithium cyanide may also be employed.

Alkali metal hydroxide is required to provide the desired operating pH for the bath of 12.5-14, and is utilized to stabilize the cyanide and to participate in the reduction reaction with the boron compound. Thus, the ratio of hydroxide to cyanide should be within the range of 4.0-10.0. As in the case of the other salts, potassium hydroxide is preferred, although sodium hydroxide is a reasonable substitute therefor.

The conventional boron compounds are used as the reducing agents in the composition. These may comprise alkali metal borohydrides and alkyl amine boranes within the range of 2-10 grams per liter and preferably 4-7 grams per liter. The preferred reducing agent is dimethyl amine borane, either alone or in combination with alkali metal borohydrides.

To provide the necessary stability for the composition, it is essential that there be included an organic stabilizer of the general formula

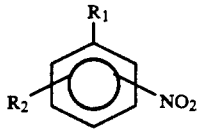

wherein $R_1$ is —COOH, —OH, —$CH_2OH$, or —$SO_3OH$ (or an alkali metal salt thereof), $R_2$ is —COOH, —OH, —Cl, —H, (or an alkali metal salt thereof and is disposed in the 2, 5, or 6 ring position, and the —$NO_2$ group is in the 3 or 4 ring position, This stabilizer is incorporated in the amount of 0.1-0.3 gram per liter, and preferably in the range of 0.15-0.25 gram per liter.

It has been observed that the stabilizer concentration in the solution may be depleted excessively between replenishment additions and this will cause the oxidation/reduction potential to exceed the limit of −700 millivolts. Accordingly, the potential is desirably monitored continuously and the stabilizer is added in small increments of 0.05-0.1 gram per liter of the plating solution to maintain the oxidation/reduction potential within the operating range of −550 to −700 millivolts. As a result, the total amount of stabilizer added over the life of the solution may range as high as 10 grams per liter.

As previously indicated, the pH of the aqueous composition should be within the range of 12.5-14.0 and preferably 13.4-14.0.

To obtain a desirable plating rate, the bath should be maintained at a temperature of 85°-95° C., and preferably 88°-93° F.

Use of the preferred compositions and temperatures will provide an effective plating rate of 3.75-6.75 microns per hour, and will produce a gold deposit of at least 99.9% purity, having a density of at least 18 grams per cc. (on the average) and a hardness of at least 85 Knoop (25 gram load maximum).

After the gold content of the solution diminishes to less than 2 grams per liter (as metal), the plating rate will begin to fall and it is necessary to replenish the composition. This is accomplished by adding alkali metal hydroxide, alkali gold cyanide and additional stabilizer. As will be appreciated, the alkali metal hydroxide is required to maintain the desired ratio of hydroxide to cyanide. Generally, the potassium hydroxide will be added to the gold replenisher solution in an amount of 1-10 grams per liter, and the potassium gold cyanide at a range of 70-90 grams per liter (as gold metal). The amount of stabilizer added will be approximately 2-6 grams per liter. Generally, it has been found that the bath may be replenished up to ten turnovers before there is a significant loss of the desirable characteristics of the plating formulation. A turnover is defined as the plating out of the amount of metal in a given volume of the solution.

In order to avoid contamination of the bath, the workpieces should be thoroughly cleaned before introduction thereinto in accordance with conventional gold plating practice.

When the workpiece is a synthetic resin or ceramic, it is necessary to initially produce an initial metallic deposit thereon and this will generally require etching with chromic acid, application of palladium/tin chloride, and immersion in an electroless copper or nickel bath.

Both such non-metallic workpieces, and metallic workpieces, must be subjected to an initial treatment to develop an immersion gold strike. Suitable compositions for developing the initial thin gold deposit include potassium gold cyanide, potassium dihydrogen phosphate and citric acid, and are maintained at a temperature of about 140°-160° F. Following the deposition of the gold strike, the workpieces are rinsed, and then they may be introduced into the electroless gold plating compositions of the present invention to produce the desired deposit.

Illustrative of the efficacy of the present invention are the following specific examples, wherein all parts are parts by weight unless otherwise indicated.

EXAMPLE ONE

A preferred bath embodying the present invention was made by adding to a precleaned and leached tank, 43 grams potassium hydroxide, 4 grams of potassium cyanide, 6 grams of potassium gold cyanide, 0.2 gram of m-nitrobenzene sulfonic acid sodium salt, 6.5 grams methyl amine borane, and deionized water to produce 1 liter of solution. The ratio of potassium hydroxide to total cyanide as potassium cyanide was 6.5, and the pH was 13.4.

The resultant bath was heated to a temperature of about 91° C. and the oxidation/reduction potential of the solution was monitored using an Orion Model SA 230 ORP Meter and combination Redox Electrode Model 9678. When the potential of the solution reached −550 millivolts, the solution was ready for use.

EXAMPLE TWO

The workpieces were flat sheets of an alloy sold by Westinghouse Electric Company under the mark KOVAR and having a nominal composition of 29% nickel, 17% cobalt, 0.3% manganese, and the balance iron. These sheets had a thickness of about 0.025 inch and were electrocleaned in a hot, caustic solution and then rinsed. The workpieces were then immersed in 50% by volume hydrochloric acid and rinsed, following after which they were introduced into a immersion plating bath comprised of potassium gold cyanide, potassium dihydrogen phosphate, and citric acid with a pH of approximately 2.5. They were removed after they had developed a uniform gold coloration upon the surface thereof.

These workpieces were then suspended in the bath of Example One, and magnetic stirring was utilized to maintain agitation of the bath thereabout. The temperature of the bath was held at 91° C.

After 20 minutes, the workpieces were removed from the bath, rinsed and dried. The deposit was found to have a thickness of approximately 72 microinches. The purity of the deposit was found to be 99.97. The deposit exhibited a satin matte finish and a lemon yellow color and, under microscopic examination, was uniform and amorphous.

EXAMPLE THREE

A Hull cell panel was thoroughly cleaned and immersed in the immersion gold plating solution of Example Two to develop a uniform gold coloration thereover. It was rinsed and then suspended in the electroless gold plating composition of Example One for a period of 3.5 hours, following which it was removed, rinsed and dried.

A cross section of the plated panel was taken, and the microhardness was determined to be 93 Knoop at 25 grams load.

EXAMPLE FOUR

Ceramic workpieces comprising an alumina base with a sintered tungsten coating and a sputtered gold deposit thereon were obtained.

These workpieces were soaked in hot alkaline solution, rinsed and then immersed in boiling hot deionized water to bring them to temperature of the bath.

Thereafter, they were suspended in the bath of Example One for a period of 30 minutes, removed, rinsed, and dried. The deposit was found to be 102 microinches of electroless gold, and the light yellow colored gold deposit was found to be of uniform, matte finish with an amorphous structure.

EXAMPLE FIVE

The plating solution of Example One was subjected to an extended turnover test involving the plating of Hull cell panels. The composition of the bath was monitored every hour to determine gold content.

Upon depletion of the gold content to a level below 3 grams per liter, the bath was replenished using a formulation comprising an aqueous solution of 80 grams per liter potassium gold cyanide, 2 grams per liter potassium hydroxide, and 4 grams per liter of m-nitrobenzene sulfonic acid sodium salt. The amount of the replenisher solution added was that calculated to restore the gold content of the plating bath to 4 grams per liter.

This procedure was repeated, and the plating rate was observed to remain essentially stable until 7 turnovers and then slowly began to decrease. The plating rate was found to vary within the range of 300 microinches initially to approximately 150 microinches per hour at 10 turnovers.

Thus, it can be seen from the foregoing detailed specification and examples that the electroless plating composition of the present invention provides a stable and effective bath for autocatalytic deposition of gold upon metallic and non-metallic workpieces. The deposits exhibit good amorphous structure, high purity and relative hardness, thus making them highly suitable for electronics applications.

Having thus described the invention what is claimed is:

1. An electroless gold plating composition comprising an aqueous solution of:

(a) alkali metal gold cyanide sufficient to provide gold (calculated as metal) in the amount of 1.0–16.6 grams per liter;

(b) alkali metal cyanide in the amount of 3–110 grams per liter;

(c) a boron compound selected from the group consisting of alkyl amine boranes, alkali metal borohydrides, and mixtures thereof, in the amount of 2–10 grams per liter;

(d) alkali metal hydroxide in the amount of 10–1100 grams per liter; and (e) 0.1–0.3 grams per liter of a stabilizer having the formula

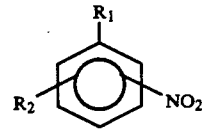

wherein $R_1$ is —COOH, —OH, —$CH_2OH$, or —$SO_3OH$ (or an alkali metal salt thereof)

$R_2$ is —COOH, —OH, —Cl, —H, (or an alkali metal salt thereof) and is disposed in the 2, 5, or 6 ring position —$NO_2$ is in the 3 or 4 ring position, said composition having a pH of 12.5–14.0, the weight ratio of $OH^-/CN^-$ being 4.0–10.0, the oxidation/reduction potential of the solution being −550 to −700 millivolts.

2. The electroless gold plating composition of claim 1 wherein said boron compound is dimethyl amine borane in the amount of 4–7 grams per liter.

3. The electroless gold plating composition of claim 1 wherein said stabilizer is nitrobenzene sulfonic acid or an alkali metal salt thereof.

4. The electroless gold plating composition of claim 1 wherein said stabilizer is present in the amount of 0.15–0.25 grams per liter.

5. The electroless gold plating composition in claim 1 wherein said composition has, at initial makeup, alkali metal cyanide in the amount of 4–6 grams per liter, and alkali metal hydroxide in the amount of 40–50 grams per liter.

6. The electroless gold plating composition of claim 1 wherein said composition has gold in the amount of 4–5 grams per liter, calculated as gold metal.

7. The electroless gold plating composition of claim 1 wherein said solution has a pH of about 13.4–14.0.

8. In a method for electroless plating of gold upon a workpiece, the steps comprising:

(a) immersion plating upon the surface of a workpiece a thin deposit of immersion gold; and (b) immersing said plated workpiece in an electroless gold plating composition comprising an aqueous solution of:

(i) alkali metal gold cyanide sufficient to provide gold calculated as metal in the amount of 1.0–16.6 grams per liter;

(ii) alkali metal cyanide in the amount of 3–110 grams per liter;

(iii) a boron compound selected from the group consisting of alkyl amine boranes, alkali metal borohydrides, and mixtures thereof, in the amount of 2–10 grams per liter;

(iv) alkali metal hydroxide in the amount of 10–1100 grams per liter; and (v) a stabilizer having the formula

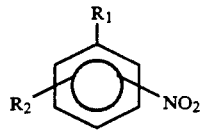

wherein $R_1$ is —COOH, —OH, —$CH_2OH$, or —$SO_3OH$ (or an alkali metal salt thereof), $R_2$ is —COOH, —OH, —Cl, —H, (or an alkali metal salt thereof) and is disposed in the 2, 5, or 6 ring position, and the —$NO_2$ group is in the 3 or 4 ring position, said composition having a pH of 12.5–14.0, the weight ratio of $OH^-/CN^-$ being 4.0–10.0, the amount of the stabilizer being in the range of 0.1–0.3 gram per liter to maintain the oxidation/reduction potential of the solution within the range of −550 to −700 millivolts, for a period of time sufficient to plate thereon high purity gold in the desired thickness.

9. The method of electroless plating of gold upon a workpiece in accordance with claim 8 wherein said solution is maintained at a temperature of about 85°–95° C.

10. The method of electroless plating of gold upon a workpiece in accordance with claim 8 wherein said boron compound is dimethyl amine borane in the amount of 4–7 grams per liter.

11. The method of electroless plating of gold upon a workpiece in accordance with claim 8 wherein said stabilizer is nitrobenzene sulfonic acid or an alkali metal salt thereof.

12. The method of electroless plating of gold upon a workpiece in accordance with claim 8 wherein said stabilizer is present in the amount of 0.15–0.25 gram per liter.

13. The method of electroless plating of gold upon a workpiece in accordance with claim 8 wherein said composition has, at initial makeup, alkali metal cyanide in the amount of 4.0–6.0 grams per liter, and alkali metal hydroxide in the amount of 40–50 grams per liter.

14. The method of electroless plating of gold upon a workpiece in accordance with claim 8 in which there is included the additional step of replenishing the composition, when the gold content (as metal) has decreased to 1.5–3 grams per liter, with a replenisher formulation comprising:

(a) alkali metal gold cyanide in the amount of 60–100 grams per liter (as metal);

(b) alkali metal hydroxide in the amount of 1–10 grams per liter; and (c) stabilizer in the amount of 2–6 grams per liter.

15. The method of electroless plating of gold upon a workpiece in accordance with claim 8 in which said electroless gold plating composition is prepared by first preparing an aqueous solution of the alkali metal hydroxide, alkali metal cyanide, alkali metal gold cyanide, stabilizer, and the boron compound, then heating the solution to operating temperature while monitoring the heated solution until the oxidation/reduction potential has reached a value of −550 to −700.

16. The method of electroless plating of gold upon a workpiece in accordance with claim 8 wherein the oxidation/reduction potential is monitored during the plating step and increments of stabilizer in the amount of 0.05–0.1 gram per liter are added to maintain the potential within the range of −550 to −700 millivolts.

* * * * *